US006823808B2

(12) United States Patent
Clary

(10) Patent No.: US 6,823,808 B2
(45) Date of Patent: Nov. 30, 2004

(54) BOAT HOIST DRIVE UNIT

(75) Inventor: Thomas W. Clary, Milford, IA (US)

(73) Assignee: Clary Investment, Inc., Milford, IA (US)

( * ) Notice: Subject to any disclaimer, the term of this patent is extended or adjusted under 35 U.S.C. 154(b) by 9 days.

(21) Appl. No.: 10/136,419

(22) Filed: May 1, 2002

(65) Prior Publication Data

US 2003/0205186 A1 Nov. 6, 2003

(51) Int. Cl.[7] ..... B63C 7/00
(52) U.S. Cl. ..... 114/44; 405/3
(58) Field of Search ..... 114/44, 366; 405/3

(56) References Cited

U.S. PATENT DOCUMENTS 4,027,492 A * 6/1977 Carpenter ..... 405/3
4,109,896 A 8/1978 Ragen
4,401,335 A 8/1983 Godbersen
4,540,329 A * 9/1985 Martin ..... 414/545
4,595,313 A 6/1986 Kotke
4,641,596 A * 2/1987 Reprogle et al. ..... 114/44
4,787,327 A * 11/1988 Porter ..... 114/44
5,090,841 A * 2/1992 Penick, Jr. et al. ..... 405/3
5,522,671 A * 6/1996 Keesling ..... 405/3
5,687,663 A * 11/1997 Wahlstrand ..... 114/44
5,746,149 A * 5/1998 Molz ..... 114/230.21
5,772,360 A * 6/1998 Wood, II ..... 405/3
5,839,851 A * 11/1998 Norfolk et al. ..... 405/3
5,888,019 A * 3/1999 Quastad ..... 405/3
5,908,264 A * 6/1999 Hey ..... 405/3
5,972,855 A * 10/1999 Honary ..... 508/491
6,056,274 A 5/2000 Naas et al.
6,306,108 B1 * 10/2001 Butler ..... 601/36
6,318,929 B1 * 11/2001 Basta ..... 405/3
6,474,253 B1 * 11/2002 Molz ..... 114/251
6,554,533 B2 * 4/2003 Godbersen ..... 405/3
6,591,770 B1 * 7/2003 Blackmore ..... 114/48

* cited by examiner

*Primary Examiner*—Andrew Wright
(74) *Attorney, Agent, or Firm*—McKee Voorhees & Sease, P.L.C.

(57) ABSTRACT

A boat hoist including a vertical frame and a horizontally disposed movable platform, with the platform movable between a lowered and boat unload position and a raised, boat load position. A cable system transmits force to move the movable platform. The cable system is operated and force transmitted to it, by a hydraulic drive unit, thus eliminating problems with electrically operated drive bar units. This results in the ability to lift heavier boats with less power and faster times. An arranged mounting for the hydraulics prevents twisting under pressure

4 Claims, 5 Drawing Sheets

BOAT HOIST DRIVE UNIT

FIELD OF THE INVENTION

The present invention relates to boat hoists and more particularly, a boat hoist system that uses a hydraulic drive unit.

BACKGROUND OF THE INVENTION

Boat hoists are, of course, known. Generally boat hoists will consist of a stationary frame member and a movable frame member, with the movable frame member being movable from an unload down (underneath the water) position to a loaded raised position (above the water). Such units must, of course be durable and be able to withstand significant environmental challenges such as constant exposure to water and sun, etc.

The operation to move such units from the unload down position to the loaded up position can take a variety of forms. For example, there have been systems in the past that raise and lower straight up and down. There have been systems that raise or lower on a slant or an angle, and there have been systems that raise or lower using rotational or pivotal movement to define a raise and lower arcuate path. All generally use some sort of cable system operable by a winch and a transmitting force, either manually (individuals wind them up or down) or electrically driven wherein a motor provides the power transmitting force.

When an electric motor is used, there must, of course, be an available electrical hook up. Such is typically provided via shore line electrical outlets and long cords, usually extending out along a dock to the boat hoist. This transmission of fairly low voltage home electrical power to the boat hoist over fairly long distances often results in loss of power. As a result, and as boats have gotten inevitably bigger, larger, and heavier, the efficiency of such units has decreased. For example, with currently available systems operating a raise/lower drive bar with a winding cable can typically raise or lower a boat in from four to six minutes. With this length of time required, many people often choose to forego electric power driven units and simply purchase hand units, using a hand rotated wheel, a winch and pulley system.

In the past, people have not looked to hydraulic drive units because of the natural tendency for hydraulic cylinder and its associated extendible arm to twist under pressure causing damage to the unit. Also, hydraulic units under water present a risk of damage both to the hydraulic unit and to the environment if they leak oil.

In can be seen, therefore, that especially for fresh water lake boat hoists, there is a continuing need for improvements in the means of transmitting the power or force to the boat hoist. Those in the manufacturing business recognize this need but have not yet achieved an attainable, practical resolution to the problem.

Accordingly, it is a primary object of this invention to provide an improved boat hoist which is operable on lower voltage requirements to achieve more efficient raising and lowering of even heavy boats at faster speeds.

Another object of this invention is to provide a boat hoist achieving the primary objective but using hydraulic driven units for greater load and unload efficiency.

A further object of the present invention is to achieve the above with hydraulic units attached in such a manner to prevent the natural twisting action of the hydraulic unit in operation, and attached so they are not ever under water, and using vegetable oil as the hydraulic fluid to avoid oil leakage into fresh water.

A further object of the present invention is to achieve the above with a unit design that can be used to retrofit existing units if one wishes to remove current conventional drive systems and replace those with hydraulic systems of the present invention.

The method of achieving each of the above, as well as other objectives will become apparent from the following detailed description of the invention which will be described with continuing reference to the drawings.

DETAILED DESCRIPTION OF A PREFERRED EMBODIMENT

Figure 1:
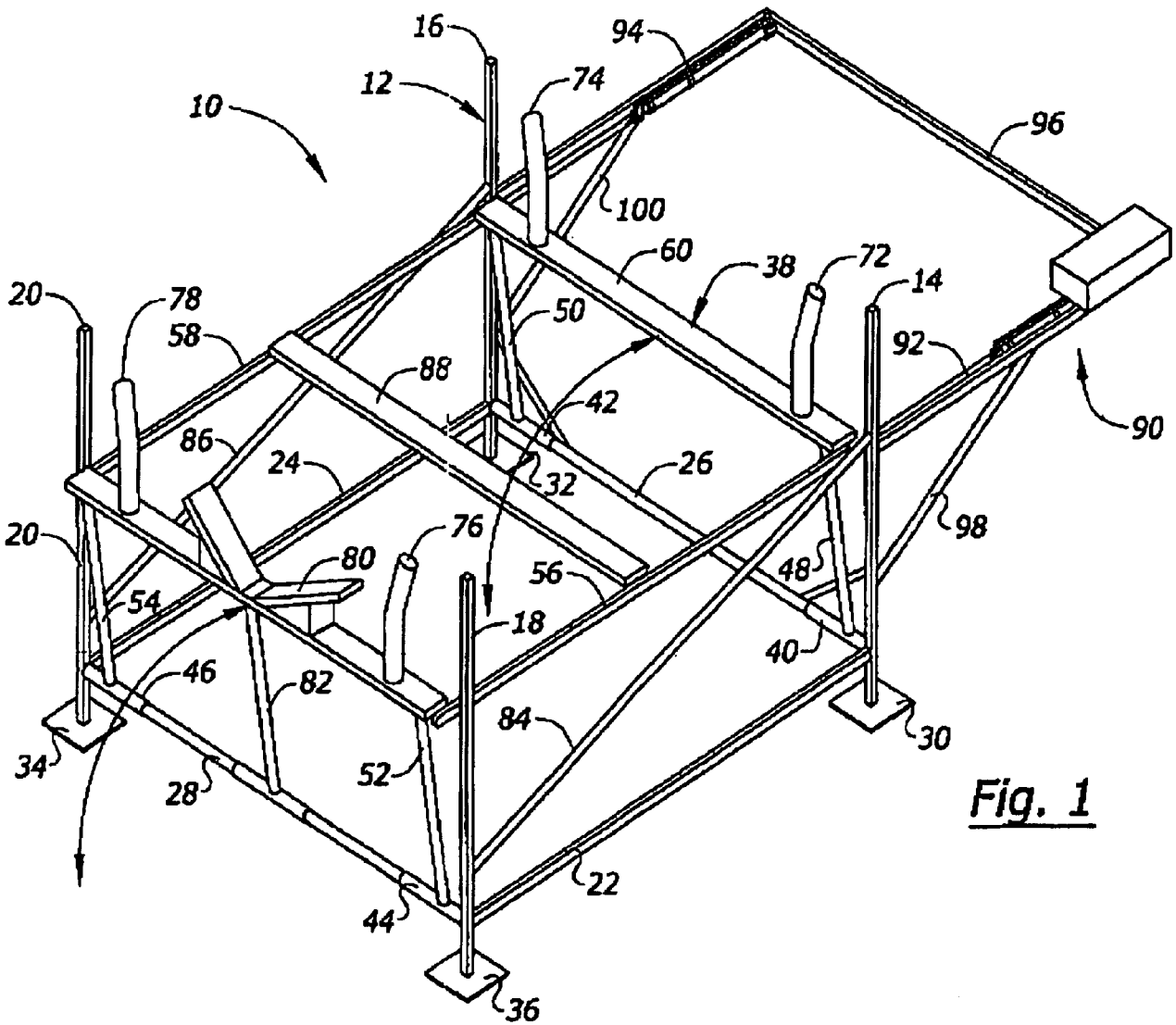
FIG. 1 is a perspective view of the boat hoist in raised position.

With continuing reference to the drawings wherein like numerals are used to designate identical parts in corresponding views, FIG. 1 shows the boat hoist 10 in perspective. The boat hoist 10 is comprised of a vertical frame 12 defined by spaced apart front posts 14 and 16 and spaced apart rear posts 18 and 20. The front and rear posts 14, 16, 18 and 20 are connected by rectangular side bars 22 and 24 and front and rear round bars 26 and 28. As depicted, the front and rear posts 14, 16, 18 and 20 can be telescopic for height adjustment. They terminate in leg platforms 30, 32, 34 and 36. A movable platform or bed 38 is defined by sleeves 40, 42, 44 and 46, each having an associated upright post 48, 50, 52, and 54. Thus, posts 48, 50, 52 and 54 are pivotally movable around the front and rear bars 26 and 28 by reason of their associated sleeves 40, 42, 44 and 46. Movable bed posts 48, 50, 52 and 54 are shorter than front and rear frame posts 14, 16, 18 and 20, as depicted. At their tops, upright posts 48, 50, 52 and 54 are joined by side frame bars 56 and 58 and front and rear frame bars, 60 and 62 via similar top sleeves 64, 66, 68 and 70. Thus, as can be seen, movable frame 38 can be pivoted to move from the upright position depicted in FIG. 1 to a lowered position such that if a boat was resting on movable frame 38, it could be raised and lowered by traveling an arcuate path.

As illustrated, optionally attached to the top of movable bed frame 38 are four guide bumpers 72, 74, 76 and 78. If desired, an adjustable cradle brackets 80 may also be used to level the boat. Also, a center pivot leg 82 may be used for additional support as well as diagonal struts 84 and 86. In similar fashion, a center support strut 88 may extend across the top of movable bed 38.

As illustrated, a drive unit support system 90 extends forward of the boat hoist 10 and is comprised of a pair of side rails 92 and 94 joined by front rail 96 with the whole of the drive unit support system 90 joined via the rearward ends of side rails 92 and 94 to front vertical posts 14 and 16. For strength, struts 98 and 100 may also be used.

Figure 3:
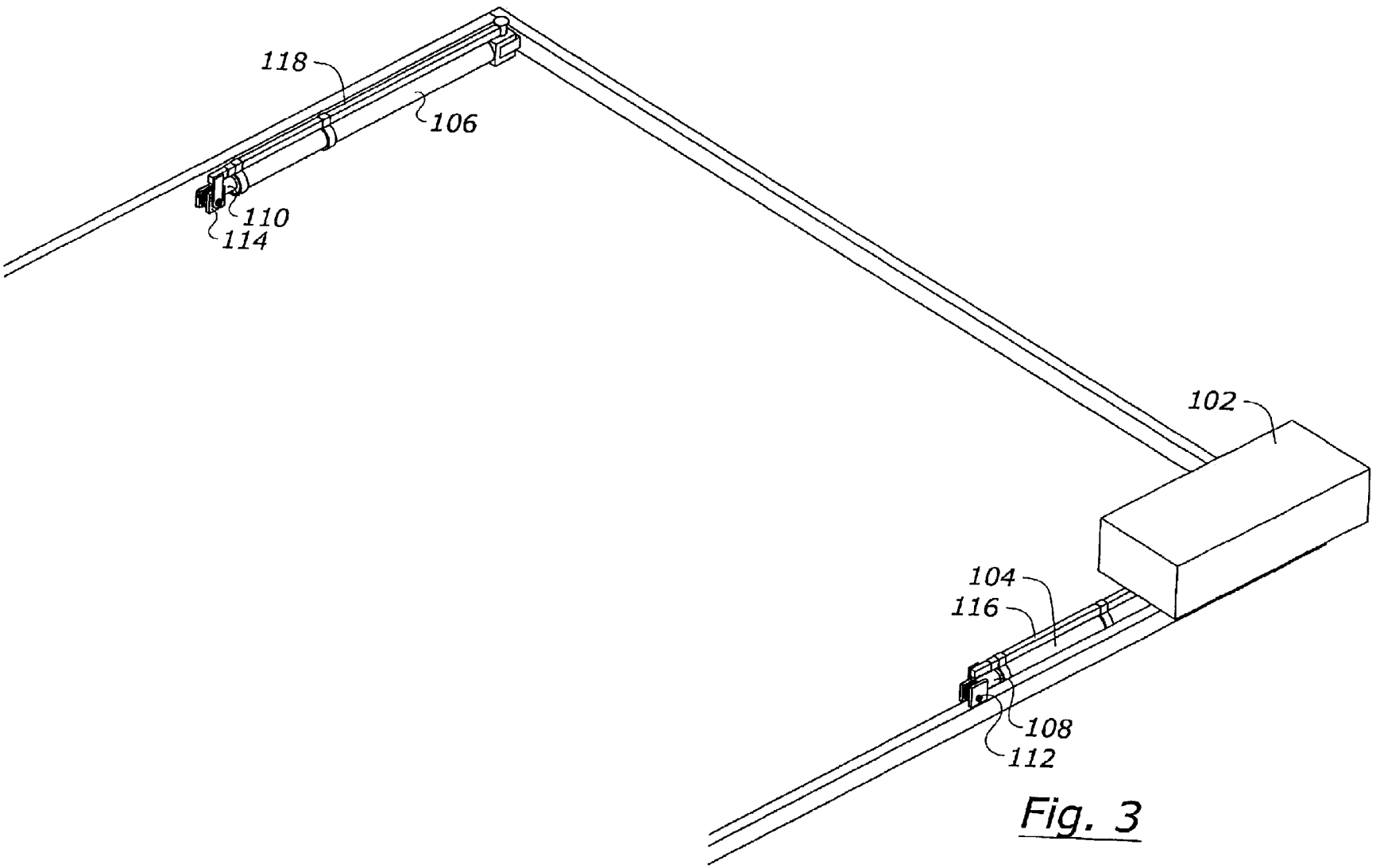
FIG. 3 is a close-up view in fragment of the hydraulic system as attached to the front bar of a hoist.
Figure 4:
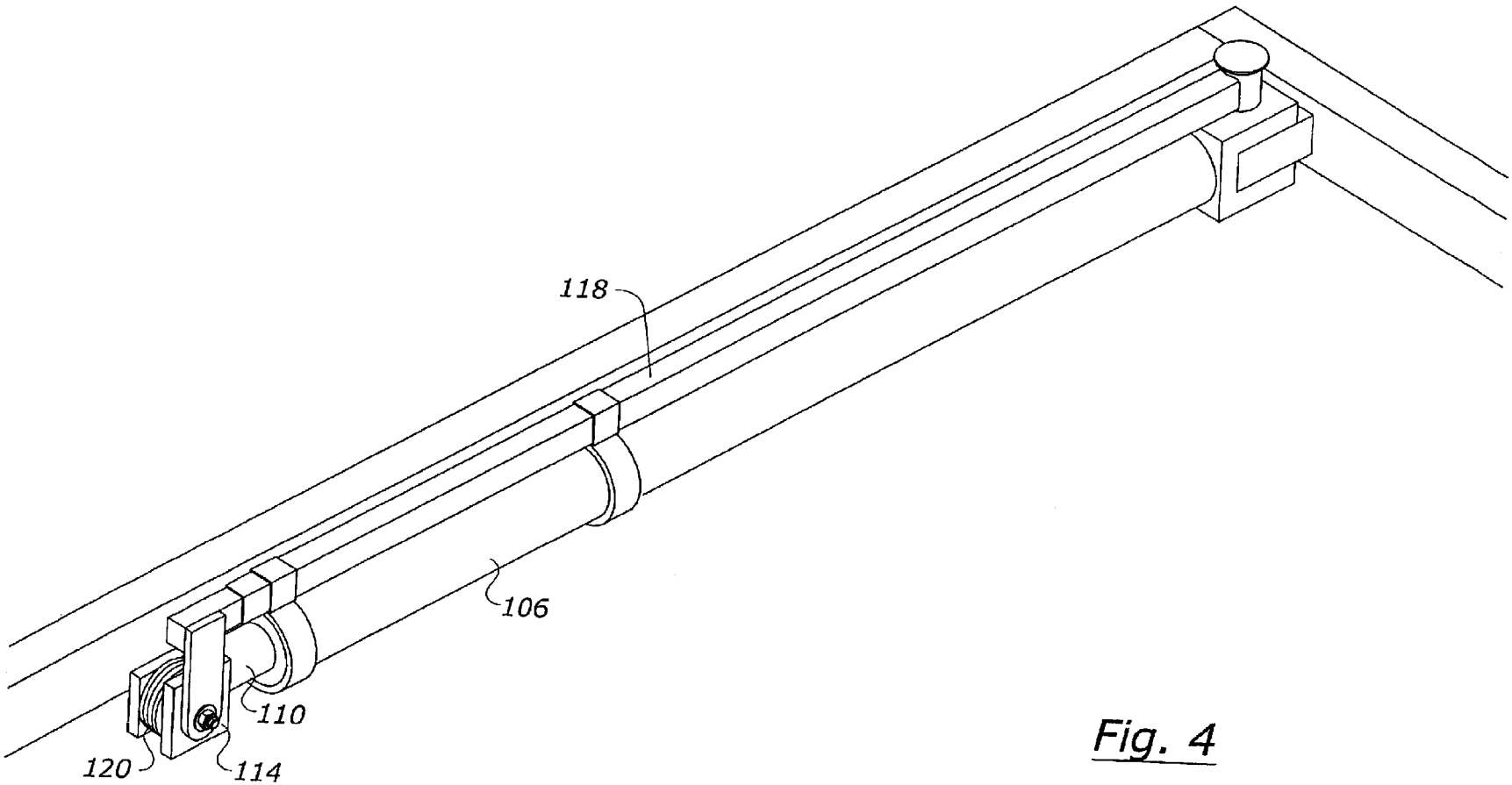
FIG. 4 shows a fragmentary exploded view of one of the hydraulic arms and its associated guide bar.

The details of the hydraulic drive unit are more clearly seen in FIGS. 3 and 4. The motor 102 is used to operate hydraulic cylinders 104 and 106 of conventional construction. Hydraulic cylinders 104 and 106 have associated extensible rods 108 and 110 terminating in top brackets 112 and 114. Each of cylinders 104 and 106 has an associated guide bar extensible arm 116, 118. Thus extension of extensible rods 108 and 110 allow the guide bar 116 and 118 to catch brackets 112 and 114 and be extended therewith. The guide bars 116 and 118 prevent the normal tendency of cylinder extensible arms 108 and 110 to rotate when pressure is applied. The necessary hydraulic hosing operation of hydraulic cylinders 104 and 106 (not depicted) may be hidden inside of front rail 96.

Figure 2:
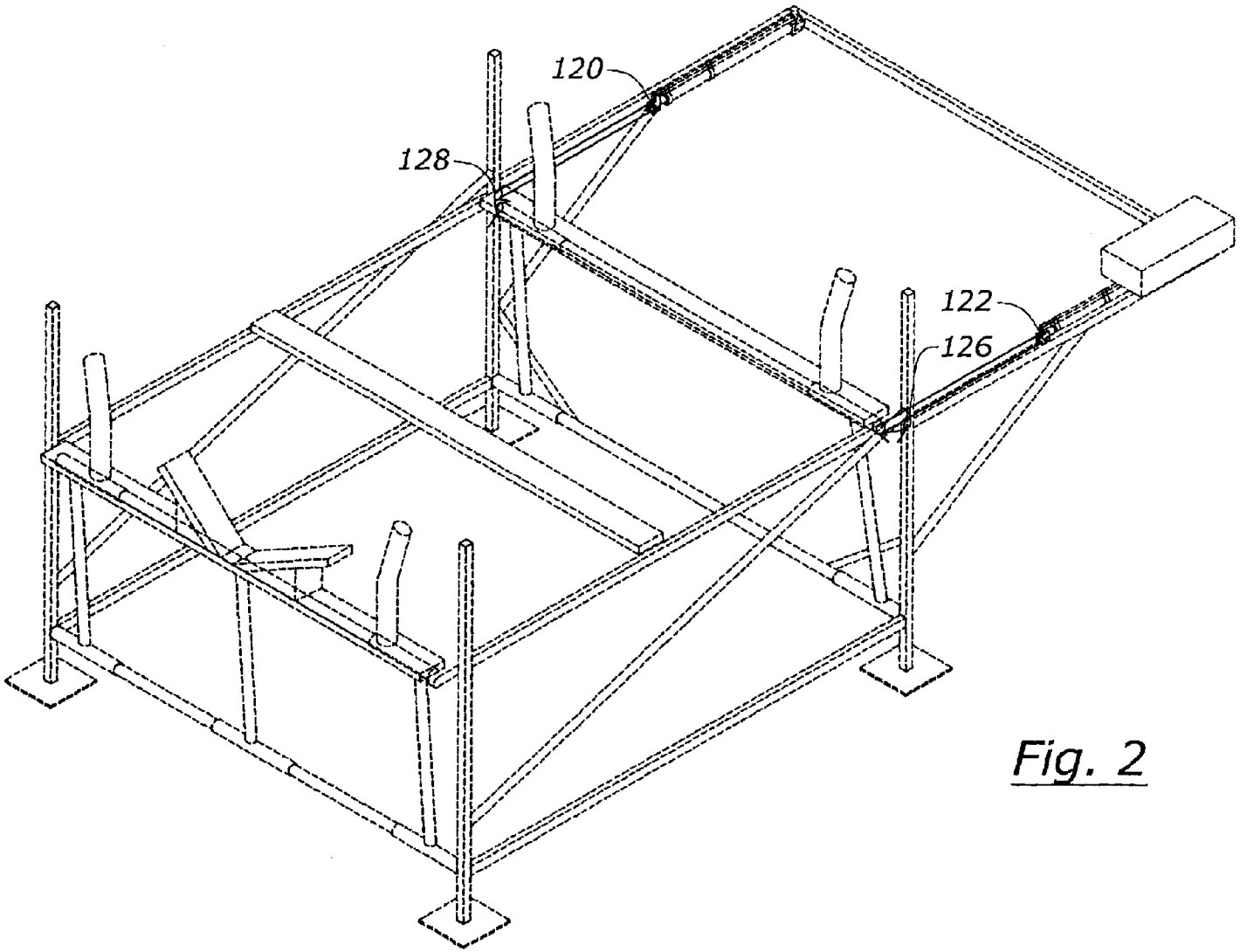
FIG. 2 is a schematic view showing detail of flexible cable and pulley systems used to transmit force to the movable platform.
Figure 5:
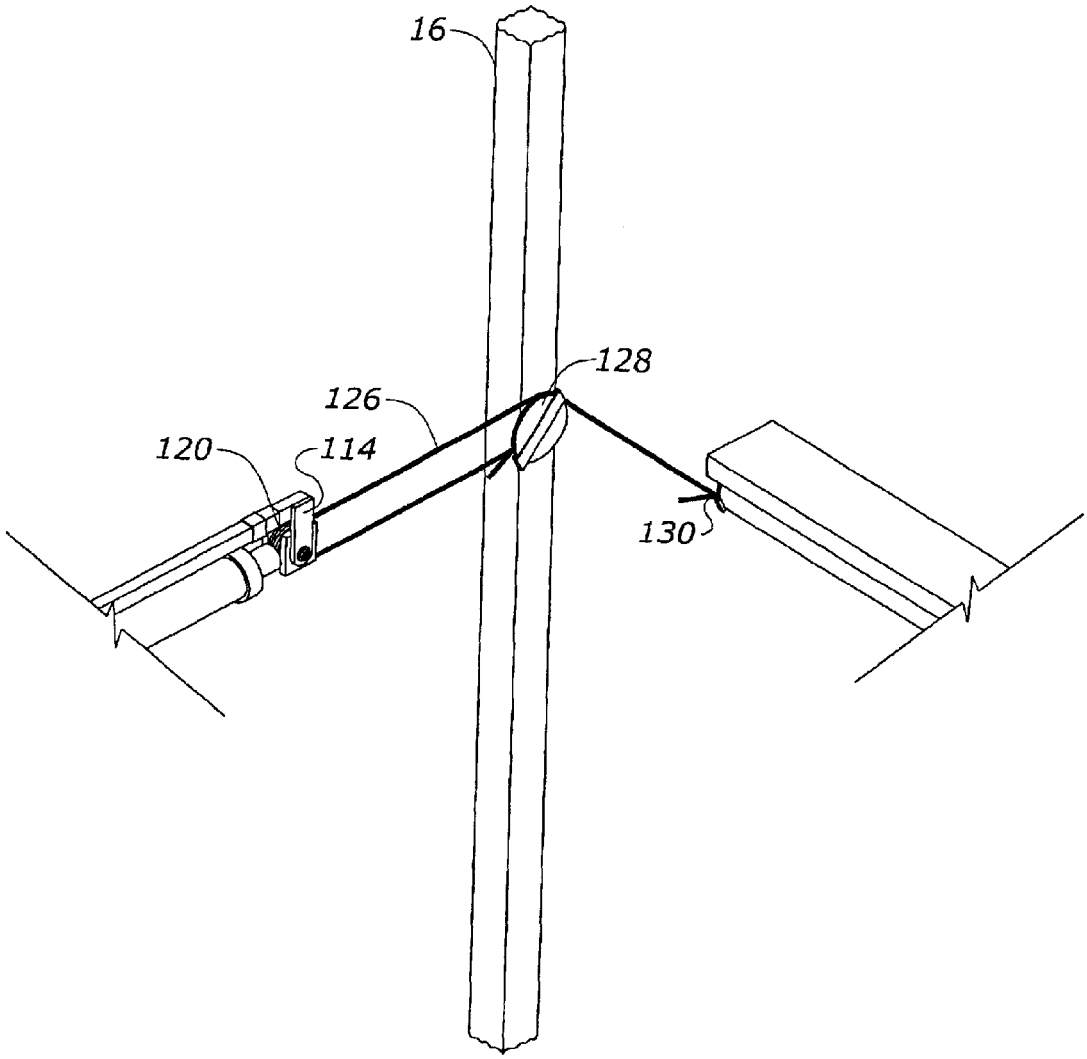
FIG. 5 shows a fragmentary view, detailing the cable hook up between the cylinder rod, the stationary frame and the movable frame.

Also associated with brackets 112 and 114 are sheaves 120 and 122. Flexible cable 126 extends around the sheaves 120 and 122 to the sheave on posts 14 and 16 (126 & 128). The flexible cable system is best depicted in FIGS. 2 and 5 with the cable being attached to movable frame 38 at 130. Thus, extension and retraction of the hydraulic cylinder rod 108 and 110 raises and lowers moveable bed 38.

As most clearly shown in FIG. 3, movable frame of bed 38 can be pivoted from its up position by activating motor 102 which extends extensible cylinder rods 108 and 110. As the rods 108 and 110 extend, the flexible cable force is transmitted to it through the lifting system which is comprised of the early described cable and sheave system. The transmitted force through the hydraulic system results in the lowering of movable frame 38. Correspondingly, the hydraulic cylinders 104 and 106 transmits an opposite force to the sheaves and cable system and results in raising movable bed 38. Thus, hydraulic cylinders 104 and 106 provide the normal force that a hand rotation of a wheel and associated common winch and cable system provides. It also provides the normal transmitting force that a conventional electric motor and winding spool provides. However, far less voltage and time is needed and in fact, the present system, by way of example and in comparison with an ordinary drive bar will raise in 65 seconds and lower in 8 seconds as opposed to about 3 minutes and 45 seconds. The hydraulics are never underneath the water and to further assure safety vegetable oil is used as the hydraulic fluid.

It can therefore be seen that the unit accomplishes all of its stated objectives.

What is claimed is:

1. A boat hoist, comprising:

a vertical frame;

a horizontally disposed movable platform attached to the vertical frame and being movable from an unloaded lowered position to a loaded raised position on an arcuate path;

a cable system for transmitting force to move said movable platform from said loaded position to said unloaded position;

a hydraulic cylinder having an extensible rod connected to said cable system and to said vertical frame to transmit force to said cable system; and the hydraulic cylinder having an associated guide bar to prevent rotational twisting of the extensible rod when the hydraulic cylinder is under pressure.

2. The boat hoist of claim 1 wherein the vertical frame has spaced apart upright front posts and spaced upright rear posts, said posts being spaced apart sufficiently to drive a boat therebetween.

3. A boat hoist, comprising:

a vertical frame;

a horizontally disposed movable platform attached to the vertical frame and being movable from an unloaded lowered position to a loaded raised position on an arcuate path;

a cable system for transmitting force to move said movable platform from said loaded position to said unloaded position;

the cable system having a flexible cable with opposing ends, one end attached to the moveable platform and the other end attached to the vertical frame;

the cable system having a sheave, the sheave engaging the flexible cable;

a hydraulic drive unit connected to said sheave to transmit force to said cable system; and the cable system has an associated guide bar attached to said sheave to prevent rotational twisting when the hydraulic drive unit is under pressure.

4. The boat hoist of claim 3 wherein the vertical frame has spaced apart upright front posts and spaced upright rear posts, said posts being spaced apart sufficiently to drive a boat therebetween.

* * * * *